US005511586A

United States Patent [19]

Lefever et al.

[11] Patent Number: 5,511,586

[45] Date of Patent: Apr. 30, 1996

[54] DEVICE FOR AFFIXING A DRIVE ELEMENT TO A LOOM WARP BEAM SHAFT

[75] Inventors: Bart Lefever, Ieper; Marc Gruwez, Zwalm, both of Belgium

[73] Assignee: Picanol N.V., Belgium

[21] Appl. No.: 381,063

[22] Filed: Jan. 31, 1995

[30] Foreign Application Priority Data

Feb. 2, 1994 [BE] Belgium ..... 09400119

[51] Int. Cl.[6] ..... D03D 49/06

[52] U.S. Cl. ..... 139/1 R; 192/93 R; 192/94; 242/535

[58] Field of Search ..... 192/114 R, 67 R, 192/93 A, 93 R, 94; 242/535, 394; 139/1 R

[56] References Cited

U.S. PATENT DOCUMENTS

| | | | |
|---|---|---|---|
| 2,049,126 | 7/1936 | Maybach | 192/67 R |
| 2,180,597 | 11/1939 | Le Bus | 197/67 R |
| 2,366,461 | 1/1945 | Shureys | 197/67 R |
| 2,803,323 | 8/1957 | Newell | 192/67 R X |
| 3,220,522 | 11/1965 | Carter, Jr. | 197/67 R |
| 3,603,436 | 9/1971 | Bartholomew | 192/67 R |
| 4,869,354 | 9/1989 | Brazler | 197/67 R |

FOREIGN PATENT DOCUMENTS

| | | | |
|---|---|---|---|
| 0451895 | 10/1991 | European Pat. Off. . | |
| 1232740 | 4/1960 | France . | |
| 1730244 | 4/1992 | U.S.S.R. | 139/1 R |

*Primary Examiner*—Andy Falik
*Attorney, Agent, or Firm*—Bacon & Thomas

[57] ABSTRACT

A device for affixing a shaft drive element to a loom warp beam shaft includes a clamping element having teeth, teeth at one end of the drive shaft and teeth on the drive element, and a displacement mechanism for sliding the clamping element and drive element on the drive shaft such that the clamping element teeth and the drive element teeth engage the drive shaft teeth. Upon sliding the drive and clamping elements over the drive shaft, the clamping and drive element teeth and the shaft teeth are mutually rotated to cause oppositely facing flanks on the drive and clamping element teeth to be pressed against corresponding flanks on the drive shaft teeth and thereby prevent relative rotation.

13 Claims, 4 Drawing Sheets

DEVICE FOR AFFIXING A DRIVE ELEMENT TO A LOOM WARP BEAM SHAFT

BACKGROUND OF THE INVENTION

1. Field of the Invention

The invention concerns a device for affixing a drive element to a loom warp beam shaft.

2. Description of Related Art

It is known to affix a drive element in the form of a gear to the warp beam shaft, the gear cooperating with another gear of a drive unit. It is also known to affix, by screws, the gear to the side of the warp beam. Such a warp beam drive gear arrangement can only, however, be used for a loom in which the drive-unit gear also is located to the side of the warp beam.

In another known warp beam drive gear arrangement, the warp beam shaft has an external thread and the gear is provided with an internal thread so that the gear can be attached to the shaft by threading. In this arrangement, part of the gear's internal thread may belong to an attachment which by means of screws can be clamped against the external thread of the warp beam, and which thereby defines a specific axial position at which the gear can be clamped. Such an affixing arrangement has the drawback that, for beams of large diameters and/or when weaving at high warp tensions, the gear may rotate relative to the beam. Moreover, this type of clamping device has the drawback that a relatively large amount of time is required to thread the gear to the desired position on the warp beam shaft.

Furthermore, a device for affixing a drive element to a loom warp beam is known from European patent document 451,895 A1, the drive element being affixed to a loom drive shaft driven by a drive motor through the intermediary of gears. The warp beam shaft is fitted with a thread that can mesh with a thread of the drive element to link the drive element to the warp beam shaft. Such a device also has a number of drawbacks, including on one hand the complexity of the device and the comparatively large amount of time needed to screw the drive element to the warp beam shaft, and on the other hand that the device may be used with only a limited number of warp beams.

SUMMARY OF THE INVENTION

It is accordingly an objective of the invention to provide a device which allows a drive element to be affixed to a warp beam shaft in a simple manner, while precluding relative rotation between the drive element and the warp beam shaft during operation.

This objective is achieved by providing a warp beam shaft fitted at one end with warp beam shaft teeth that can be engaged by teeth associated with a beam drive element, and by providing a clamping element which also is fitted with teeth able to mesh with the teeth of the warp beam shaft or with the drive element teeth, the clamping element being arranged to rotate the drive element and the warp beam shaft relative to each other such that tooth flanks of the drive element teeth and tooth flanks of the warp beam shaft teeth are pressed against each other.

The device of the invention offers the advantage that the drive element can be affixed by a simple axial displacement along the warp beam shaft, allowing rapid affixation, and at the same time. The device of the invention also allows the drive element to be axially affixed at nearly arbitrary positions and without play to the warp beam shaft.

In a preferred embodiment of the invention, a clamping element is provided in the form of a disk secured by at least one axially directed screw against the drive element, and at least one key is present between the clamping and drive elements, the key precluding opposite rotational motions by the clamping and drive elements when the screw is being turned. Since the clamping element is mounted on the drive element, the clamping element does not need to be concurrently exchanged when the warp beam is being exchanged, and since the screw is axial, it is advantageously accessible regardless of warp beam position.

Further features and advantages of the invention are elucidated in the following description and in relation to the illustrative embodiment shown in the drawings.

DETAILED DESCRIPTION OF THE PREFERRED EMBODIMENTS

Figure 1:
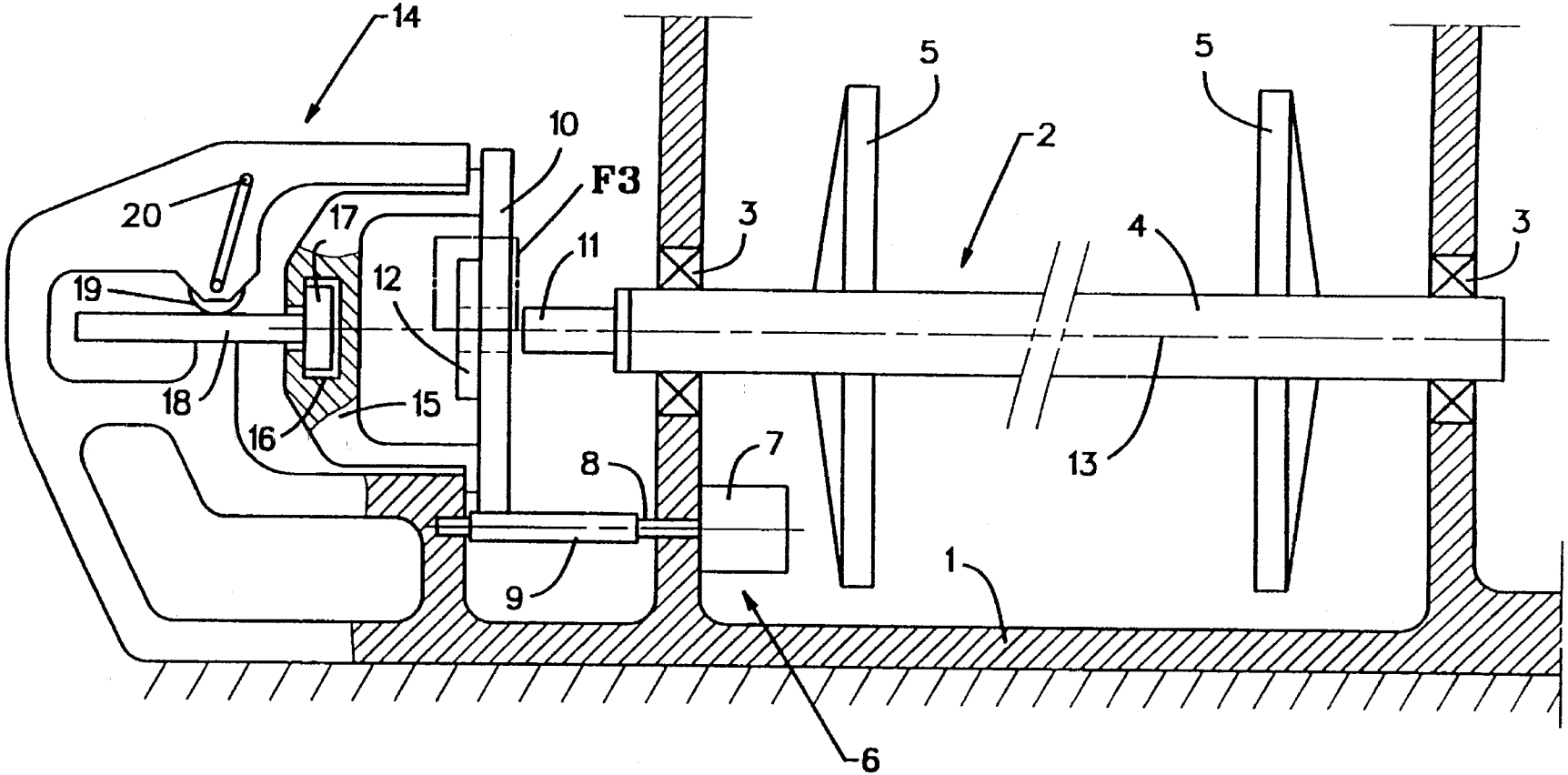
FIG. 1 is a schematic diagram of a device according to a preferred embodiment of the invention, showing the situation in which the drive element is separated from the warp beam shaft.
Figure 2:
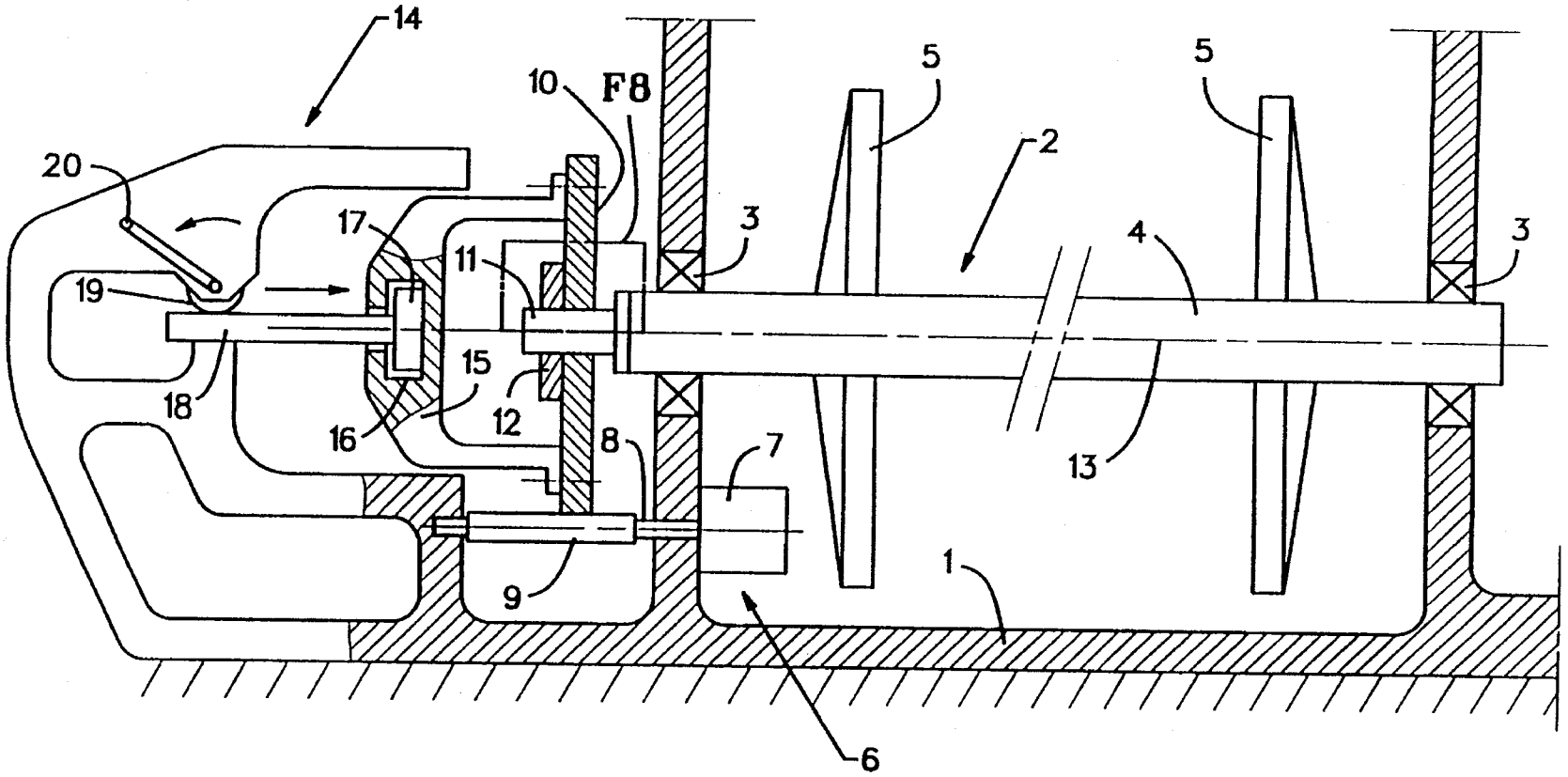
FIG. 2 is a schematic diagram of the device of FIG. 1, in which the drive element is affixed to the warp beam shaft.
Figure 5:
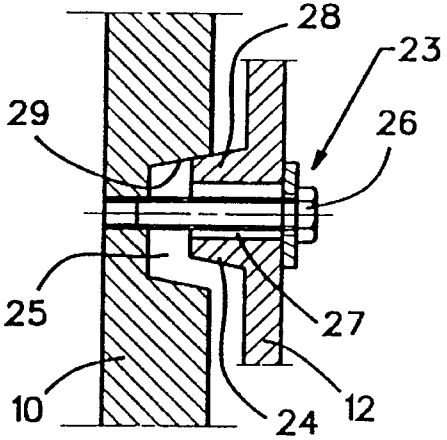
FIG. 5 is a section along line V—V of FIG. 4.
Figure 7:
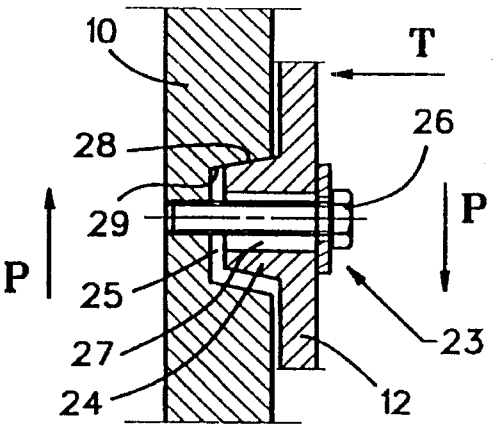
FIG. 7 is a section along line VII—VII of FIG. 6.

The loom shown in diagrammatic form in FIGS. 1 and 2 includes a frame 1 for supporting a warp beam 2 by bearings 3, as is known, in such a manner that the warp beam can be inserted into and removed from the frame 1. The warp beam 2 includes a warp beam shaft 4 to which are affixed warp beam disks 5. The warp threads are wound on the warp beam shaft 4 between the warp beam disks 5. The loom further contains a drive unit 6 for the warp beam 2. Drive unit 6 in turn contains a drive motor 7, and a gear 9 affixed to the motor shaft 8 so as to rotate with the shaft.

The gear 9 meshes with a gear 10 that can be mounted on an attachment 11 of the warp beam shaft 4 in a manner discussed below, and which can be affixed by a clamping element 12. Gear 10 is held in place by a displacement mechanism 14 and can be moved in the direction of the axis 13 of the warp beam 2 onto the attachment 11 of the warp beam shaft 4. The displacement mechanism 14 includes a holder 15 affixed by screws to the gear 10. In a zone away from the gear 10, the holder 15 includes an undercut clearance 16 in which is mounted, with comparatively large play, a thickened head 17 of an actuator bar 18. The actuator bar 18 is fitted with a gear rack engaged by a gear 19 which can be rotated by a lever 20 or a crank. In the situation shown in FIG. 1, gear 10 is supported by gear 9 and further, by means of the holder 15, by head 17 of the actuator bar 18, although those skilled in the art will appreciate that other or additional support means may be provided to support gear 10 in this situation.

Gear 10 is linked to the warp beam shaft 4 by using the displacement mechanism 14 to slide gear 10 onto the attachment 11 of the warp beam shaft 4 so that it is held on the warp beam shaft 4, as shown in FIG. 2. Because of the play in the cooperation between the clearance 16 and the head 17, the holder 15 may remain affixed to the gear 10 while weaving takes place. To make it easier to slide gear 10 onto the attachment 11, gear 10 is preferably provided with additional support means (not shown) so that gear 10 is first mounted underneath the longitudinal axis 13 and then raised when being slipped on.

After the gear 10 has been fitted onto attachment 11 of warp beam shaft 4, it is connected in play-free manner with the attachment by means of axially extending external warp beam shaft teeth 31 on attachment 11, which form multiple keys, and corresponding axially extending internal drive element teeth 21 in gear 10 which are slipped onto external warp beam shaft teeth 31. The clamping element 12 also includes internal teeth 22 which also extend axially so that they may be slipped onto the external teeth 31 of attachment 11. In practice, the internal teeth 21 of the gear 10 and the internal teeth 22 of the clamping element 12 have the same dimensions. However, they are depicted in FIGS. 4, 6, 9, and 10 and having different dimensions so as to more clearly show the principle of operation of the preferred arrangement.

Figure 9:
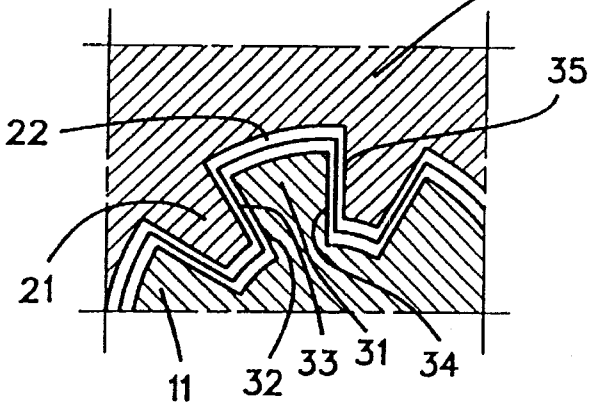
FIG. 9 is a section along line IX—IX of FIG. 8.
Figure 10:
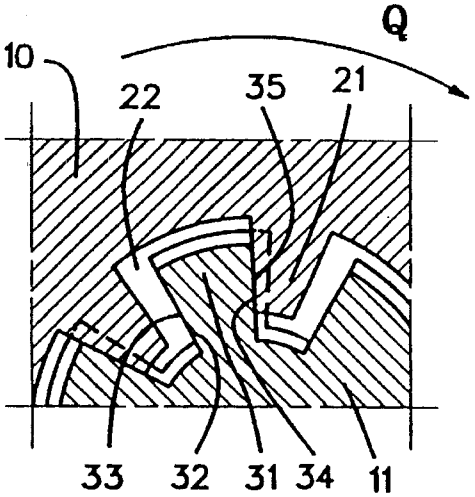
FIG. 10 is a section corresponding to that of FIG. 9 after the drive element and the clamping element have been rotated.
Figure 3:
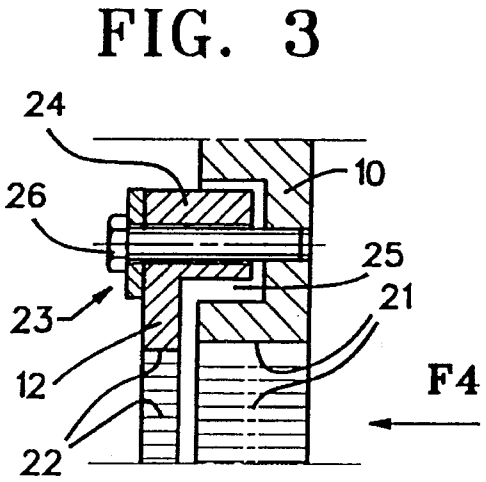
FIG. 3 shows a large-scale detail F3 of the drive shaft of FIG. 1.

Gear 10 and clamping element 12 are mutually rotatable about axis 13 and affixable to attachment 11 by tightening means 23 discussed in further detail below. When the gear 10 is fitted onto attachment 11, its internal teeth 21 and the internal teeth 22 of the clamping element 12 are aligned flush with one another, as shown in FIG. 9. In that position, they are aligned jointly relative to the external teeth 31 of attachment 11 of the warp beam shaft 4 and slipped onto the external teeth. To make slipping-on easier, the internal teeth 21 and 22 may be shaped to be blade-like or sloped at their end faces. Following slip-on, the gear 10 and the clamping element 12 are mutually rotated by the actuation of the tightening means 23, as a result of which the tooth flanks 35 of internal teeth 21 of gear 10 are pressed to rest against internal teeth 22 of the clamping element 12 at mutually opposite tooth flanks 32, 34 of the external teeth 31 of the attachment 11, as illustrated in FIG. 10. Play-free linkage between the gear 10 and the attachment 11 is thereby achieved.

The direction of the warp tension is indicated by Q in FIG. 10. The relative rotation between the gear 10 and the clamping element 12 is selected so that the forces in the direction of warp tension Q are directly transmitted from the tooth flanks 34 of the external teeth 31 of attachment 11 to the tooth flanks 35 of the internal teeth 21 of the gear 11. Because warp beam 2 is driven during weaving by the warp tension and decelerated by the drive unit 6, the largest forces arise in the direction of warp tension. Appropriately, therefore, the maximum forces are transmitted directly between the gear teeth 21 and the teeth 31 of the attachment 11, and thus the tightening means 23 are not stressed by these forces.

As shown in FIGS. 3–7, clamping element 12 is affixed to gear 10 by three axially directed screws 26, each 120° from the other. To this end, clamping element 12 includes projections 24 in the region of screws 26, the projections entering clearances 25 in the gear 10. In the region of the projections 24, the clamping element 12 also includes clearances 27 for the screws 26, with clearances 27 providing a relatively large play in the circumferential direction relative to the screws 26. The projections 24 and the clearances 25 are fitted with mutually opposite key surfaces 28, 29 running radially and axially. By tightening the screws 26 in the direction of arrow T, the key surfaces 28, 29 slide onto each other, whereby the gear 10 and the clamping element 12 are rotated relative to each other and moved in the mutually opposite directions indicated in FIG. 7 by arrow P. From FIGS. 4 and 6, it can be seen that the opposite movement of the clamping element 12 and drive element or gear 10 in the directions indicated by arrows P corresponding to rotations about a common axis (see also, FIGS. 1 and 2) in the directions indicated by arrows R. Because the rotation of clamping element 12 is restricted by engagement between flanks 33 on the internal teeth 22 of the clamping element and flanges 32 on the external warp beam shaft teeth 31, it follows that mutual rotation of the clamping element and drive element will cause flanks 35 on internal teeth 21 of gear 10 to be pushed and held against opposite side flanges 34 on the external warp beam shaft teeth 31 On account of this opposite rotation, therefore the effect illustrated in FIGS. 9 and 10 is achieved, namely that the tooth flanks 35 of the internal teeth 21 of the gear 10 are pressed against the tooth flanks 34 of the external teeth 31 of the attachment 11, and the tooth flanks 33 of the internal teeth 21 of the clamping element 12 are pressed against the tooth flanks 32 of the external teeth 31 of the attachment 11. As a result, any play is compensated for, with ensuing advantages concerning wear, vibration and noise. Accordingly, the external teeth 31 of attachment 11 of the warp beam shaft 4, on the one hand, and internal teeth 21 of gear 10 and internal teeth 22 of the clamping element 12, on the other hand, may be manufactured with relatively large mutual play, the relatively large mutual play being entirely compensated for by the tightening means 23. Relatively large play makes the slipping-on operation easier.

Figure 8:
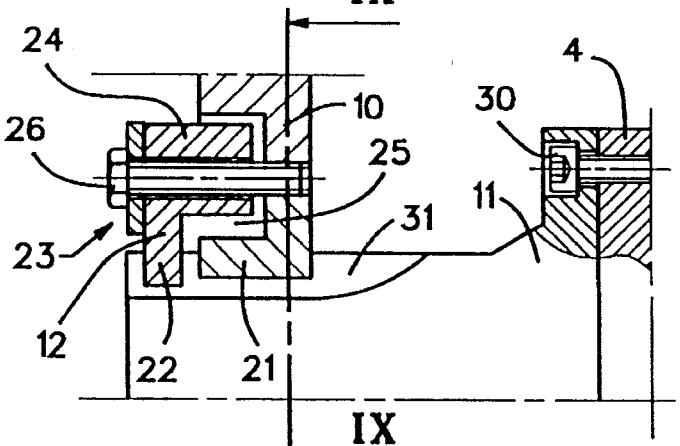
FIG. 8 is a detail F8 of FIG. 2 shown on a larger scale.
Figure 4:
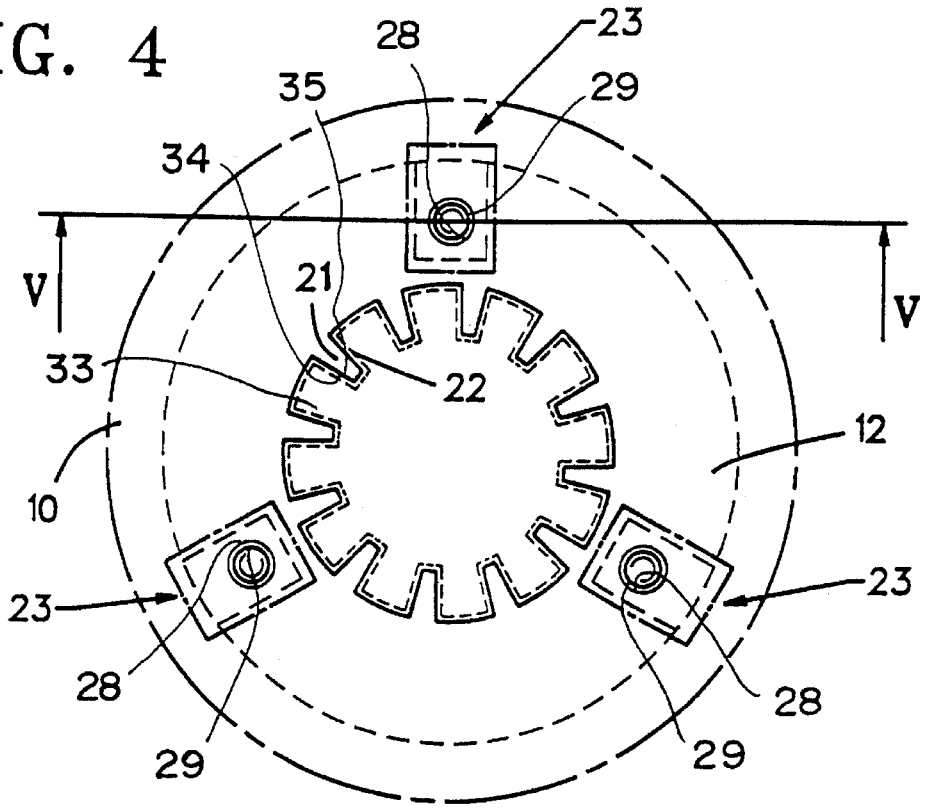
FIG. 4 is an elevation seen in the direction of the arrow F4 of a detail of the drive element of FIG. 1.
Figure 6:
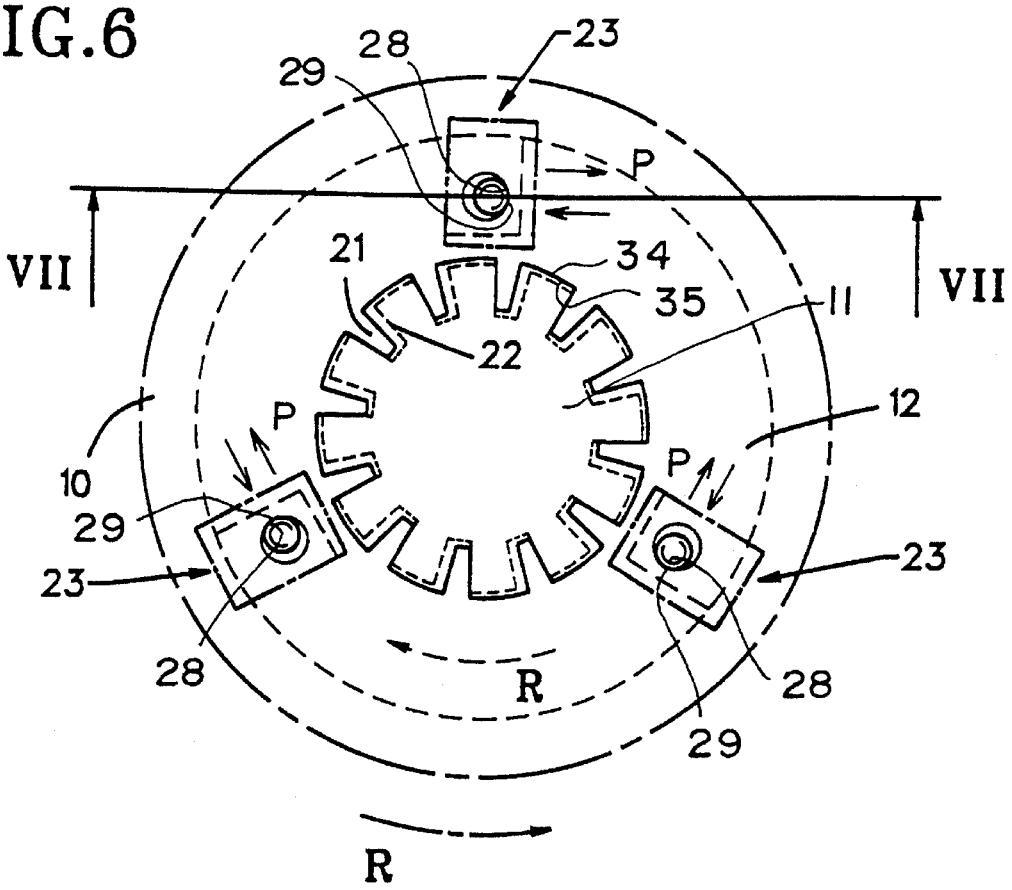
FIG. 6 is an elevation corresponding to the elevation of FIG. 4 in which the clamping element and the drive element are mutually rotatable.

FIG. 8 also shows that the attachment 11 fitted with the external teeth 31 is affixed by screws 30 to one end face of the warp beam shaft 4.

In a variation of the above-described embodiment of the invention, gear 19 of the displacement mechanism 14 is driven not by a manual lever 20, but rather by an adjusting motor. In a further variation, the bar 18 is hydraulically or pneumatically displaceable.

In another embodiment of the invention, tightening means other than those denoted by reference numeral 23 are used to implement the mutual rotation of the clamping element 12 and the gear 10. For example, adjustment screws may be mounted into the gear 10 to tangentially act on the clamping element and thereby achieve relative rotation. Further, keys radially displaceable by screws and entering channels to achieve rotation also may be used. In a further variation, keys may be provided on gear 10 and the associated channels may be present at the clamping element.

In yet another embodiment of the invention, the clamping element and tightening means are provided at the warp beam, and tightening means are present between the clamping element and the warp beam in order to impart mutual rotation to the teeth of the clamping element and to the teeth of the warp beam in such a way that the teeth of the clamping element and the teeth of the drive element, for instance a gear, are mutually stressed.

In a variation of these embodiments, an affixing component which includes external teeth is present at the drive element, whereas the warp beam is fitted with internal teeth able to cooperate with the external teeth of the affixing component. The tightening means and the clamping element in this variation may be mounted on the drive element or at the warp beam.

Finally, because gear 10 in the displacement mechanism 14 is held in place with relatively large play, it is also possible, where called for, to compensate for deviations radial to the axis of the warp beam shaft.

Having thus described several preferred embodiments of the invention, and several variations and modifications thereof, in sufficient detail to enable those skilled in the art to make and use the invention, it should nevertheless be appreciated that still further variations and modification of the invention will undoubtedly occur to those skilled in the art, and thus that the invention should not be limited by the above description and drawings, but rather that the invention should be interpreted solely in accordance with the appended claims.

We claim:

1. An arrangement for driving a warp beam, said arrangement including a warp beam shaft having teeth, a warp beam drive element having teeth, and warp beam drive means for driving the drive element, the teeth on the warp beam shaft and the teeth on the drive element each having tooth flanks, said arrangement further comprising:

a clamping element; and means for causing the drive element and the warp beam shaft to rotate relative to each other such that the tooth flanks of the drive element teeth and the tooth flanks of the warp beam shaft teeth are pressed and held against each other to prevent relative movement between the drive element and the warp beam after the drive element has been placed on the warp beam drive shaft.

2. An arrangement as claimed in claim 1, wherein the clamping element is a disk and further comprising means including at least one axially directed screw for holding the disk against the drive element, and means including at least one key connection between the clamping element and the drive element for implementing a mutually opposite rotation of the clamping and drive elements when the screw is turned, whereby the mutually opposite rotation which causes the warp beam shaft teeth to be pressed against the drive element teeth compensates for play between the respective drive element teeth and warp beam shaft teeth which allows the respective drive element teeth and warp beam shaft teeth to be easily fitted over each other.

3. An arrangement as claimed in claim 2, comprising a plurality of said axially directed screws, and wherein the means for implementing a mutually opposite rotation of the clamping and drive elements comprises a plurality of said axial directed screws, projections on the clamping element, and clearances in the drive element, said projections including clearances which allow the screws to pass through the projections to be threaded into the drive element, and wherein the clamping element projections and the drive element clearance include mutually engageable key surfaces which slide against each other as the screws are threaded into the drive element to thereby rotate the clamping element and drive element relative to each other.

4. An arrangement as claimed in claim 2, further comprising teeth on the clamping element engageable with said teeth on the warp beam shaft to restrict rotation of the clamping element in a first direction relative to the warp beam shaft and thereby cause rotation of the drive element in a second direction relative to the warp beam shaft upon relative rotation between the drive element and the clamping element to thereby cause the tooth flanks of the drive element teeth to be pressed and held against the tooth flanks of the warp beam shaft teeth.

5. An arrangement as claimed in claim 4, wherein the warp beam shaft teeth are external teeth and wherein the drive element teeth and teeth of the clamping element are internal teeth positioned to fit over the external warp beam shaft teeth.

6. An arrangement as claimed in claim 1, wherein the flanks of the warp beam shaft teeth against which the drive element teeth are pressed face a direction of unwinding of the warp beam.

7. An arrangement as claimed in claim 1, further comprising means including a displacement mechanism for holding the drive element and moving it in an axial direction of the warp beam shaft.

8. An arrangement as claimed in claim 7, wherein the drive element is a gear and is movable by the displacement mechanism in an axial direction of the warp beam shaft along an adjustment path, and further comprising a drive gear which engages the drive element and has an axial length corresponding at least to a length of the adjustment path.

9. An arrangement as claimed in claim 7, wherein the displacement mechanism comprises a drive element holder, a clearance in said holder, an actuator bar having a head positioned in said clearance, and means for moving said actuator bar to thereby move the holder and the drive element in order to slide the drive element onto the warp beam shaft, whereby said clearance in the holder permits the holder to remain affixed to the drive element during weaving.

10. An arrangement as claimed in claim 9, wherein the means for moving the actuator bar comprises a lever connected to a gear which engages a rack on the actuator bar.

11. An arrangement as claimed in claim 1, further comprising a drive gear which engages the drive element and has an axial length which is at least as long as an adjustment path over which the drive element may be moved.

12. An arrangement as claimed in claim 1, wherein the warp beam shaft teeth are on an attachment affixed to an end of the warp beam shaft.

13. An arrangement as claimed in claim 12, wherein the attachment is affixed to an end face of the warp beam shaft by screws.

* * * * *